United States Patent [19]

Moberg

[11] 4,015,456

[45] Apr. 5, 1977

[54] PLUNGER-OPERATED LOCK

[75] Inventor: Sigurd M. Moberg, Etlan, Va.

[73] Assignee: E. J. Brooks Company, Newark, N.J.

[22] Filed: June 28, 1976

[21] Appl. No.: 700,078

[52] U.S. Cl. ..... 70/34; 70/386; 70/395

[51] Int. Cl.[2] ..... E05B 67/36

[58] Field of Search ..... 70/32–34, 70/386, 395, 397, 398, 399, 19

[56] References Cited

UNITED STATES PATENTS

| | | | |
|---|---|---|---|
| 3,033,016 | 5/1962 | Moberg | 70/395 |
| 3,446,045 | 5/1969 | Finck | 70/34 |
| 3,714,802 | 2/1973 | Morse | 70/34 |
| 3,835,674 | 9/1974 | Hoyt | 70/34 |

*Primary Examiner*—Robert L. Wolfe
*Attorney, Agent, or Firm*—R. E. Ross

[57] ABSTRACT

A lock of the type having an internal plunger with a stem for being gripped by a tool to pull the stem axially to release locking means, in which said stem has a separate portion protruding from the rear end which is spring biased against the forward portion of the stem. When attempts are made by unauthorized persons to open the lock by forcing an elongated member (such as a piece of tubing) into engagement with the protruding portion, the protruding portion is driven back into the forward portion, so that the tubing cannot become engaged therewith.

5 Claims, 5 Drawing Figures

PLUNGER-OPERATED LOCK

BACKGROUND OF THE INVENTION

In the electric meter box art it is becoming increasingly necessary to provide positive means for locking the cover of the meter box closed, to prevent unauthorized persons from gaining access to the terminals inside the box. Locking is often accomplished by the use of a so-called barrel lock or plunger lock, such as is shown in my U.S. Pat. No. 3,186,196 issued June 1, 1965.

This lock comprises a housing and a pair of balls which are moved outwardly into the locking position by an internal axially movable plunger. The plunger is spring biased to the locking position, and is moved to the unlocking position by the insertion of an expandable tool into the end of a hollow stem of the plunger. The tool frictionally grips the internal walls of the stem so that tension can be applied to the plunger to pull it, against the force of the spring, to the unlocking position.

However, it has been found that it is possible to jam an article, such as a wire with a suitably bent end, into the stem cavity and with sufficient perseverance to obtain sufficient frictional engagement with the internal stem wall to pull the plunger to the unlocking position.

SUMMARY OF THE INVENTION

To prevent the possibility of defeating a lock of this type, I have provided a separate tool-engaging member in a recess on the rear end of the plunger, said member having a pin protruding through a cover plate on the rear end of the recess. The separate tool-engaging member is spring-biased against the bottom of a recess in the plunger. When an axial pulling force is applied to the pin, it pulls the plunger rearwardly in the usual manner to release the locking means. However, when a pushing force is applied to the pin, it is forced into the recess through the opening in the cover plate to become inaccessible, and preventing an unauthorized tool from gripping engagement therewith.

DESCRIPTION OF THE ILLUSTRATED EMBODIMENT

Figure 1:
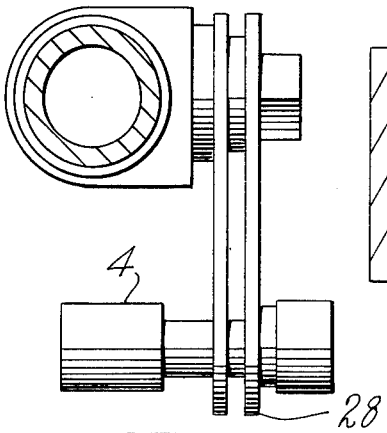
FIG. 1 is a view in side elevation of a valve assembly illustrating the use of the improved lock disclosed herein.

Referring to the drawing, there is illustrated a plunger type lock 10 which comprises a housing 12 having a closed end 13, an open end 14, and a plunger 15 movable axially in the housing to move a pair of locking balls 16 between an unlocking and a locking position.

Figure 2:
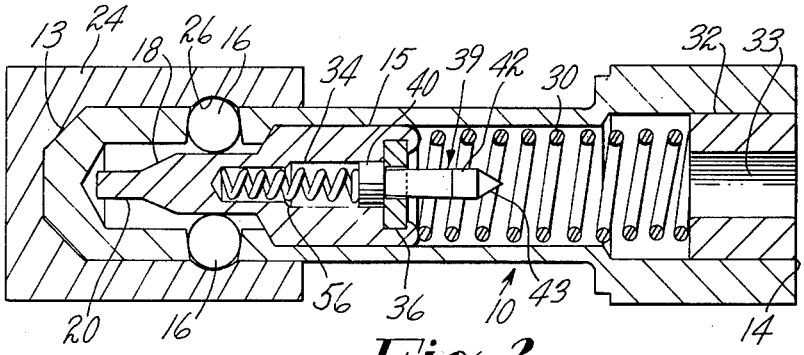
FIG. 2 is a view in longitudinal section taken on line 2—2 of FIG. 1.
Figure 3:
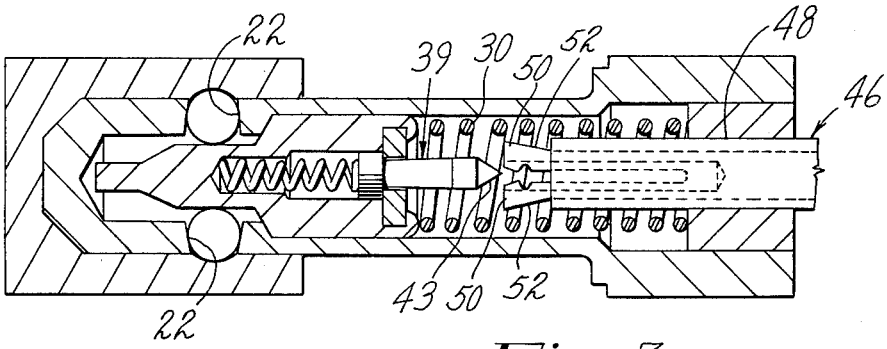
FIGS. 3 and 4 are views similar to FIG. 2 illustrating the method of opening the lock with a suitable tool.
Figure 4:
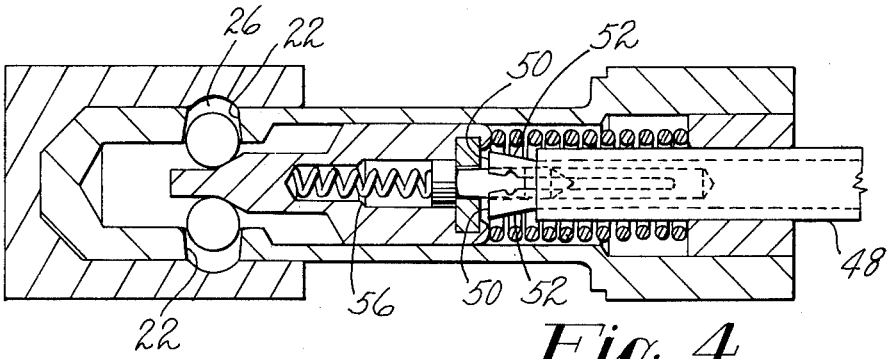

The forward end of the plunger 14 is provided with a forwardly projecting cylindrical member having a rear portion 18 and a smaller forward portion 20. The balls 16 are retained in suitable apertures 22 in the housing wall. The parts are so dimensioned that when the plunger is in the forward or locking position (see FIG. 2) the portion 18 of the plunger is disposed between the balls forcing them outwardly so that they project from the outer surface of the housing, and when the plunger is retracted, the smaller portion 20 is disposed between the balls, so that they can move inwardly.

In FIG. 1 the lock is illustrated as being used with a separate locking cap 24, which has an internal groove 26 in which the balls 16 seat to retain the cap locked onto the end of the lock 10. This assembly may be used to lock the operating lever 28 of a valve in a desired position. However, the lock 10 may also be used to lock the cover of a meter box in the closed position, or to lock a meter retaining ring. In such application, instead of locking in a separate cap 24, the lock may extend into an aperture in a suitably positioned bracket. Such an assembly is shown in U.S. Pat. No. 3,867,822.

The plunger 15 is biased to the forward position (as in FIG. 1) by a spring 20 disposed between the rear end of the plunger and a bushing 32 press-fitted or otherwise retained in the open end 14 of the housing 12. The bushing has a central opening 33 for receiving a lock operating tool, as will be described hereinafter.

To provide means for retracting the plunger to release the lock, a cavity 34 is provided in the rear end of the plunger, with a cover plate 36 retained over the cavity entrance. The cover plate 36 has a central aperture 38 in which is assembled a pin 39 having an enlarged head 40 disposed in the cavity 34 and a tool engaging portion 42 extending through the cover plate aperture 38 and protruding therefrom toward the open end of the housing in alignment with the aperture 33 in the bushing. The portion 42 has a conical end 43 for a purpose to appear hereinafter.

The pin 39 is biased to the extended position by a spring 44 disposed between the cavity bottom and the enlarged head 40.

The lock may be released by a suitable tool 46, which, in the illustrated embodiment, comprises an elongated hollow housing 48 retained within which is a pair of jaws 50 which normally protrude from the housing and are spread apart far enough to receive the protruding portion 42 of the pin therebetween. The outer end portion of the jaws 50 have outwardly inclined surfaces 52 and means (not shown) is provided to cause the jaws 50 to be retracted into the housing, whereby the surfaces 52 cam the jaws together to cause them to grip the pin portion 42. Retracting motion of the tool will thereafter pull the pin and plunger rearwardly toward the open end of the housing, against the force of spring 30, to move the smaller forward end 20 of the plunger into alignment with the balls 16 so that they move inwardly to the unlocking position.

Tools of a type suitable for grasping and pulling a pin of the type described are well known in the art and do not form part of the present invention. A form of tool for this purpose is illustrated in U.S. Pat. No. 3,446,045 issued May 27, 1969.

Attempts to open the illustrated lock will be made by unauthorized persons with various types of tools. Previous locks with protruding pins have been successfully opened by driving a piece of tubing of suitable internal diameter over the end of the pin, to frictionally grip the pin with sufficient strength to allow it to pull the plunger against the force of the biasing spring.

Figure 5:
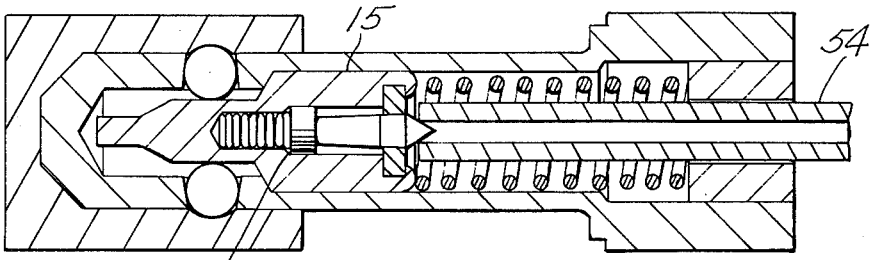
FIG. 5 is a view similar to FIG. 2 showing the action of the tool engaging member when an unauthorized tool such as a piece of tubing is used in an attempt to defeat the lock.

However, as illustrated in FIG. 5, an attempt to drive a tubing 54 over the protruding portion of the pin causes the pin to retract through the cover plate 36.

The dimensions of the components are such that when the enlarged head 40 of the pin bottoms against a shoulder 56 in the cavity 34, substantially only the conical end 43 protrudes from the cover plate, which is impossible for the tubing to grip.

The conical end 43, in addition to facilitating the positioning of the tool jaws 50 over the pin, also tends to deflect other types of inserted implements, such as thin blades or wires, to prevent them from being wedged between the pin and the cover plate.

Since certain changes apparent to one skilled in the art may be made in the illustrated embodiment of the invention without departing from the scope thereof, it is intended that all matter contained herein be interpreted in an illustrative and not a limiting sense.

I claim:

1. A lock of the plunger operated type, having a housing open at one end, a lock operating plunger axially movable in the housing and biased forwardly away the open end and a tool-engagable member mounted on the operating plunger said member being spring biased to normally extend rearwardly therefrom and being movable forwardly into an inaccessible position on the application of a forward axial force thereto.

2. A lock as set forth in claim 1 in which said plunger has a cavity opening to the rear end thereof, a cover plate having a central opening disposed over the cavity opening, said tool engagable member having an enlarged head portion disposed in the cavity and a tool-engagable portion extending from the head portion through the central opening of the cover plate, spring bias means in the cavity biasing the tool-engagable member to the extended position for grasping by a tool for pulling the plunger toward the open end of the housing, said tool-engagable portion being movable through the cover plate into the cavity on the application of an axial forward force thereto.

3. A lock of the plunger operated type having an elongated housing open at one end, a lock operating plunger axially movable in the housing, said plunger being spring biased forwardly away from the open end into the locking position and a tool-engagable member mounted in the plunger and extending rearwardly therefrom toward the open end of the housing, said member being spring biased into the rear position for grasping by a tool to pull the plunger rearwardly into the unlocking position, and being movable into the plunger into an inaccessible position by the application of a forward axial force thereto.

4. A plunger operated lock as set out in claim 3 in which the plunger has a cavity opening to the rear end thereof, said tool-engageable member is retained in the cavity normally protruding therefrom and retreats into the cavity on the application of an axial forward force against the member.

5. A plunger operated lock of the type having a housing open at one end, a plunger in the housing and axially movable between a forward position in which the plunger retains locking elements in a locking position and a rear position in which the locking elements can move to a non-locking position and in which means is provided on the plunger extending toward the open end for grasping by a suitable tool to pull the plunger to the unlocking position, in which the rear end of the plunger is provided with a cavity and a separate pin is mounted in said cavity and is biased rearwardly to normally protrude from the rear of the plunger for grasping by a tool to pull the plunger rearwardly into the unlocking position, said pin being movable forwardly into said cavity so as to be inaccessible in response to a forward axial force applied thereto.

* * * * *